US008647161B2

(12) United States Patent
Leblanc

(10) Patent No.: US 8,647,161 B2
(45) Date of Patent: Feb. 11, 2014

(54) METHOD OF CONTROLLING A PERSONAL WATERCRAFT

(75) Inventor: Jean-Yves Leblanc, Sherbrooke (CA)

(73) Assignee: Bombardier Recreational Products Inc., Valcourt (CA)

( * ) Notice: Subject to any disclaimer, the term of this patent is extended or adjusted under 35 U.S.C. 154(b) by 549 days.

(21) Appl. No.: 12/687,346

(22) Filed: Jan. 14, 2010

(65) Prior Publication Data

US 2010/0178815 A1 Jul. 15, 2010

Related U.S. Application Data

(60) Provisional application No. 61/144,854, filed on Jan. 15, 2009.

(51) Int. Cl.
*B63H 21/12* (2006.01)
*B60L 3/00* (2006.01)
*B63H 11/11* (2006.01)

(52) U.S. Cl.
USPC ..... 440/1; 701/21; 440/41

(58) Field of Classification Search
USPC ..... 440/1, 40, 41; 701/21
See application file for complete search history.

(56) References Cited

U.S. PATENT DOCUMENTS

| | | | | |
|---|---|---|---|---|
| 2,606,626 | A | | 8/1952 | Meyer |
| 2,911,053 | A | | 11/1959 | Ayers et al. |
| 3,414,074 | A | | 12/1968 | Dannettell |
| 3,507,350 | A | | 4/1970 | Boyajian |
| 3,807,343 | A | | 4/1974 | Peebles |
| 4,270,716 | A | | 6/1981 | Anderson |
| 4,458,115 | A | | 7/1984 | Peterson |
| 4,743,213 | A | * | 5/1988 | Nishida ..... 440/1 |
| 4,941,854 | A | | 7/1990 | Takahashi et al. |
| 5,397,890 | A | | 3/1995 | Schueler et al. |
| 6,086,168 | A | | 7/2000 | Rump |
| 6,263,261 | B1 | | 7/2001 | Brown et al. |
| 6,324,446 | B1 | | 11/2001 | Brown et al. |
| 6,338,012 | B2 | | 1/2002 | Brown et al. |
| 6,409,286 | B1 | | 6/2002 | Fennel |

(Continued)

FOREIGN PATENT DOCUMENTS

| | | | |
|---|---|---|---|
| DE | 19846352 | A1 | 4/1999 |
| DE | 102006012246 | A1 | 3/2007 |

(Continued)

OTHER PUBLICATIONS

English Abstract of Application No. DE102006012246.

(Continued)

*Primary Examiner* — Stephen Avila
*Assistant Examiner* — Andrew Polay
(74) *Attorney, Agent, or Firm* — BCF LLP

(57) ABSTRACT

A personal watercraft comprises at least one seat including a driver seating portion and at least one passenger seating portion. At least one sensor is disposed on the watercraft for detecting at least one of a presence and an absence of a passenger on the watercraft. A control unit is electrically connected to the at least one sensor. The control unit enters a first control mode in response to a signal received from the at least one sensor indicative of the presence of a passenger on the watercraft. The control unit prevents at least one performance characteristic of the watercraft from exceeding a predetermined value when in the first control mode.

25 Claims, 4 Drawing Sheets

(56) References Cited

U.S. PATENT DOCUMENTS

| | | | | |
|---|---|---|---|---|
| 6,450,845 | B1 | 9/2002 | Snyder et al. | |
| 6,465,907 | B2 | 10/2002 | Ueno et al. | |
| 6,643,573 | B2 | 11/2003 | Dickinson et al. | |
| 6,745,112 | B2 | 6/2004 | Mori | |
| 6,772,061 | B1 | 8/2004 | Berthiaume et al. | |
| 6,876,917 | B1 | 4/2005 | Bates, Jr. et al. | |
| 6,951,203 | B2 | 10/2005 | Spaulding | |
| 7,044,814 | B2 * | 5/2006 | Kamio et al. | 440/1 |
| 7,068,178 | B2 | 6/2006 | Oh | |
| 7,523,803 | B2 | 4/2009 | Breed | |
| 7,892,053 | B2 * | 2/2011 | St-Pierre et al. | 440/40 |
| 2002/0115357 | A1 * | 8/2002 | Hiki et al. | 440/1 |
| 2004/0029459 | A1 * | 2/2004 | Berthiaume et al. | 440/1 |
| 2006/0180372 | A1 | 8/2006 | Mercier et al. | |
| 2009/0084623 | A1 | 4/2009 | Dagenais | |

FOREIGN PATENT DOCUMENTS

| | | | |
|---|---|---|---|
| EP | 2055617 | A1 | 5/2009 |
| WO | 03058359 | A1 | 7/2003 |
| WO | 2007130043 | A1 | 11/2007 |

OTHER PUBLICATIONS

English abstract of Application No. DE19846352.

* cited by examiner

METHOD OF CONTROLLING A PERSONAL WATERCRAFT

CROSS-REFERENCE

This application claims priority from U.S. Provisional Application No. 61/144,854, filed Jan. 15, 2009, the entirety of which is incorporated herein by reference.

FIELD OF THE INVENTION

The present invention relates to a method of controlling a personal watercraft.

BACKGROUND OF THE INVENTION

Personal watercraft are sometimes designed with a straddle-type seat to support a driver and one or more passengers seated in tandem behind the driver.

Unlike the driver, the passengers on a personal watercraft generally do not have a handlebar on which they must grip to operate the personal watercraft and by the same occasion brace themselves against change of motion induced forces, thus they must attempt to brace themselves against these forces in other ways. In this regard, most personal watercraft are provided with grab handles or a seat strap on the seat for the passengers to grip, as well as foot rests designed to support the lower limbs and provide a third contact point to stabilize the posture. However, as the grab handles need not to be held for the personal watercraft to operate. The passengers often find themselves not holding on anything to maintain their posture on the personal watercraft. Although this practice is acceptable in steady state motion phases of the operation of the personal watercraft, it nevertheless exposes the passengers to the risk of not being able to react timely to the forces induced by a sudden motion change commanded by the driver resulting in an unanticipated imbalance state of the passengers and a possible subsequent fall to the water. This situation is at odds with the driver's desire to use the personal watercraft at its maximum performance potential as when no passenger is present.

In addition, the passengers are less able to anticipate the forces than the driver who is in control of the movement of the watercraft. The passengers may not have advance notice that the driver intends to cause the watercraft to begin moving, change speed or turn. As a result, the passengers may not expect the forces that they will experience due to these actions by the driver. While these forces are varying in magnitude, simply not anticipating them may be enough to cause some unsteadiness. This further decreases the enjoyment of the passengers. With the development of more powerful personal watercraft, and in particular with the use of four-stroke engines in personal watercraft, more torque is generated at low engine speeds, resulting in faster and more sudden acceleration even at the start of the ride.

Therefore, there is a need for a personal watercraft wherein the forces experienced by the passengers during acceleration of the watercraft are controlled.

There is also a need for a method of controlling the forces experienced by the passengers on a tandem personal watercraft during acceleration of the personal watercraft.

There is also a need for a method of controlling the rate of change of the forces experienced by passengers on a tandem personal watercraft.

SUMMARY OF THE INVENTION

It is an object of the present invention to ameliorate at least some of the inconveniences present in the prior art.

It is also an object of the present invention to provide a method of operating a personal watercraft whereby a control unit limits a performance characteristic of the personal watercraft in response to detecting a passenger on the personal watercraft. The driver can selectively operate the personal watercraft in a mode wherein the performance characteristic is not limited.

It is also an object of the present invention to provide a method of operating a personal watercraft whereby a control unit limits a performance characteristic of the personal watercraft at engine start-up. The driver can selectively operate the personal watercraft in a mode wherein the performance characteristic is not limited.

In one aspect, the invention provides a personal watercraft comprising a watercraft body having a hull and a deck disposed on the hull. An engine is supported by the hull. A jet propulsion system is supported by the hull and is operatively connected to the engine to propel the watercraft. At least one straddle-type seat is supported on the deck. The at least one seat includes a driver seating portion for receiving a driver and at least one passenger seating portion for receiving at least one passenger. A steering device is disposed generally forwardly of the driver seating portion for steering the watercraft. At least one sensor is disposed on the watercraft for detecting at least one of a presence and an absence of a passenger on the watercraft. A control unit is electrically connected to the at least one sensor. The control unit controls an operation of the watercraft. The control unit enters a first control mode in response to a signal received from the at least one sensor indicative of the presence of a passenger on the watercraft. The control unit prevents at least one performance characteristic of the watercraft from exceeding a predetermined value when in the first control mode.

In an additional aspect, when the control unit is in the first control mode, the control unit enters a second control mode in response to at least one of a signal received from the at least one sensor and actuation of at least one switch disposed on the watercraft body. The at least one switch is electrically connected to the control unit. The signal from the at least one sensor is indicative of the absence of a passenger. The control unit allows the at least one performance characteristic of the watercraft to exceed the predetermined value when in the second control mode.

In a further aspect, the sensor detects at least one of a degree of compression of the passenger seating portion, a movement of the at least one passenger seating portion relative to the watercraft body, a weight exerted on the passenger seating portion, and a force applied on the watercraft body by a rear portion of the seat.

In an additional aspect, the at least one performance characteristic includes at least one of a torque output of the engine, a rate of change of the torque output, an acceleration of the watercraft, and a rate of change of the acceleration of the watercraft. The predetermined value is a corresponding one of a predetermined torque output of the engine, a predetermined rate of change of the torque output, a predetermined acceleration of the watercraft, and a predetermined rate of change of the acceleration of the watercraft.

In a further aspect, the predetermined value is determined by the control unit as a function of at least one of a speed of the watercraft and a speed of the engine.

In an additional aspect, when the control unit is in the first control mode, the control unit allows the performance characteristic of the watercraft to exceed the predetermined value when a current speed of the watercraft is greater than a predetermined threshold speed.

In a further aspect, a reverse gate is disposed generally rearwardly of the jet propulsion system and is movable between a stowed position and at least one position wherein the reverse gate redirects a flow of water expelled from the jet propulsion system. When the control unit is in the first control mode, the control unit allows the performance characteristic of the watercraft to exceed the predetermined value when the reverse gate is in the at least one position.

In an additional aspect, a display cluster is disposed generally forwardly of the driver seating position. The control unit causes information to be displayed on the display cluster in response to the control unit entering the first control mode.

In a further aspect, actuation of the at least one switch when the control unit is in the first control mode causes the control unit to enter the second control mode only after the information has been displayed for a predetermined amount of time.

In an additional aspect, the at least one sensor is capable of detecting one of a presence and an absence of a plurality of passengers on the watercraft. When the control unit is in the second control mode and the watercraft is in an idle state, the control unit enters the first control mode in response to a signal received from the at least one sensor indicative of the presence of an increased number of passengers on the watercraft.

In a further aspect, when the control unit is in the first control mode, the control unit enters a second control mode in response to a signal received from the at least one sensor. The signal from the at least one sensor is indicative of the absence of a passenger. The control unit allows the at least one performance characteristic of the watercraft to exceed the predetermined value when in the second control mode. The control unit enters the first control mode at engine start-up, independently of the signal received from the at least one sensor indicative of the presence of a passenger on the watercraft.

In another aspect, the invention provides a method of controlling a personal watercraft. The method comprises causing a control unit to enter a first control mode in response to a signal received from at least one sensor indicative of a presence of a passenger on the watercraft, causing the control unit to enter a second control mode in response to an other signal when the control unit is in the first control mode, preventing at least one performance characteristic of the watercraft from exceeding a predetermined value while the control unit is in the first control mode, and allowing the at least one performance characteristic of the watercraft to exceed the predetermined value while the control unit is in the second control mode.

In an additional aspect, the other signal is at least one of a signal received from the at least one sensor indicative of an absence of a passenger on the watercraft, and a signal received from at least one driver-actuated switch of the watercraft.

In a further aspect, the method further comprises allowing the at least one performance characteristic of the watercraft to exceed the predetermined value when a speed of the watercraft is greater than a predetermined threshold speed when the control unit is in the first control mode.

In an additional aspect, the watercraft has a reverse gate disposed generally rearwardly of a jet propulsion system. The reverse gate is movable between a stowed position and at least one position wherein the reverse gate redirects a flow of water expelled from the jet propulsion system. The method further comprises allowing the at least one performance characteristic of the watercraft to exceed the predetermined value when the reverse gate is in the at least one position and the control unit is in the first control mode.

In a further aspect, the other signal is the signal received from the at least one driver-actuated switch. The signal received from the at least one driver-actuated switch is a first signal received from the at least one driver-actuated switch. The method further comprises causing the control unit to enter a towing mode in response to a second signal received from the at least one driver-actuated switch of the watercraft, allowing the driver to select an acceleration profile of the watercraft from a plurality of predetermined acceleration profiles while in the towing mode, and preventing the control unit from entering the first control mode while the control unit is in the towing mode.

In an additional aspect, when the control unit is in the second control mode and the watercraft is in an idle state, the method further comprises causing the control unit to enter the first control mode in response to a signal received from at least one sensor indicative of an increased number of passengers on the watercraft.

In a further aspect the method further comprises displaying information on a display cluster when the control unit is in the first control mode.

In an additional aspect, the method further comprises causing the control unit to enter the second control mode in response to the first signal only after the information has been displayed for a predetermined period of time.

In a further aspect, the at least one performance characteristic includes at least one of a torque output of an engine of the watercraft, a rate of change of the torque output, an acceleration of the watercraft, and a rate of change of the acceleration of the watercraft. The predetermined value is a corresponding one of a predetermined torque output of the engine, a predetermined rate of change of the torque output, a predetermined acceleration of the watercraft, and a predetermined rate of change of the acceleration of the watercraft.

In an additional aspect, the predetermined value is determined by the control unit as a function of at least one of a speed of the watercraft and a speed of the engine.

In yet another aspect, the invention provides a personal watercraft comprising a watercraft body having a hull and a deck disposed on the hull. An engine is supported by the hull. A jet propulsion system is supported by the hull and operatively connected to the engine to propel the watercraft. At least one straddle-type seat supported on the deck. The at least one seat includes a driver seating portion for receiving a driver and at least one passenger seating portion for receiving at least one passenger. A steering device is disposed generally forwardly of the driver seating portion for steering the watercraft. A control unit is electrically connected to the engine. The control unit controls an operation of the watercraft. The control unit enters a first control mode at engine start-up. At least one switch is disposed on the watercraft body. The at least one switch is electrically connected to the control unit. Actuation of the at least one switch when the control unit is in the first control mode causes the control unit to enter a second control mode. The control unit prevents at least one performance characteristic of the watercraft from exceeding a predetermined value when in the first control mode. The control unit allows the at least one performance characteristic of the watercraft to exceed the predetermined value when in the second control mode.

In an additional aspect, the at least one performance characteristic includes at least one of a torque output of the engine, a rate of change of the torque output, an acceleration of the watercraft, and a rate of change of the acceleration of the watercraft. The predetermined value is a corresponding one of a predetermined torque output of the engine, a predetermined rate of change of the torque output, a predetermined acceleration of the watercraft, and a predetermined rate of change of the acceleration of the watercraft.

In a further aspect, the predetermined value is determined by the control unit as a function of at least one of a speed of the watercraft and a speed of the engine.

In an additional aspect, when the control unit is in the first control mode, the control unit allows the performance characteristic of the watercraft to exceed the predetermined value when a current speed of the watercraft is greater than a predetermined threshold speed.

In a further aspect, a reverse gate disposed generally rearwardly of the jet propulsion system and being movable between a stowed position and at least one position wherein the reverse gate redirects a flow of water expelled from the jet propulsion system. When the control unit is in the first control mode, the control unit allows the performance characteristic of the watercraft to exceed the predetermined value when the reverse gate is in the at least one position.

In an additional aspect, a display cluster disposed generally forwardly of the driver seating position. The control unit causes information to be displayed on the display cluster in response to the control unit entering the first control mode.

In a further aspect, actuation of the at least one switch when the control unit is in the first control mode causes the control unit to enter the second control mode only after the information has been displayed for a predetermined amount of time.

In another aspect, the invention provides a method of controlling a personal watercraft, comprising causing a control unit to enter a first control mode at engine start-up, causing the control unit to enter a second control mode in response to a first signal received from at least one driver-actuated switch of the watercraft when the control unit is in the first control mode, preventing at least one performance characteristic of the watercraft from exceeding a predetermined value while the control unit is in the first control mode, and allowing the at least one performance characteristic of the watercraft to exceed the predetermined value while the control unit is in the second control mode.

In an additional aspect, the method further comprises allowing the at least one performance characteristic of the watercraft to exceed the predetermined value when a speed of the watercraft is greater than a predetermined threshold speed when the control unit is in the first control mode.

In a further aspect, the personal watercraft has a reverse gate disposed generally rearwardly of a jet propulsion system. The reverse gate is movable between a stowed position and at least one position wherein the reverse gate redirects a flow of water expelled from the jet propulsion system. The method further comprises allowing the at least one performance characteristic of the watercraft to exceed the predetermined value when the reverse gate is in the at least one position and the control unit is in the first control mode.

In an additional aspect, the method further comprises causing the control unit to enter a towing mode in response to a second signal received from the at least one driver-actuated switch of the watercraft, allowing the driver to select an acceleration profile of the watercraft from a plurality of predetermined acceleration profiles while in the towing mode, preventing the control unit from entering the first control mode while the control unit is in the towing mode.

In a further aspect, the method further comprises displaying information on a display cluster when the control unit is in the first control mode, and causing the control unit to enter the second control mode in response to the first signal only after the information has been displayed for a predetermined period of time.

In an additional aspect, the at least one performance characteristic includes at least one of a torque output of the engine, a rate of change of the torque output, an acceleration of the watercraft, and a rate of change of the acceleration of the watercraft. The predetermined value is a corresponding one of a predetermined torque output of the engine, a predetermined rate of change of the torque output, a predetermined acceleration of the watercraft, and a predetermined rate of change of the acceleration of the watercraft.

In a further aspect, the predetermined value is determined by the control unit as a function of at least one of a speed of the watercraft and a speed of the engine.

For purposes of this application, terms indicating direction such as "forwardly", "rearwardly", "left" and "right" in relation to a personal watercraft should be understood as they would be understood by a driver sitting on the personal watercraft in a normal riding position. In addition, the term "passenger" in relation to a personal watercraft should be understood to mean a person riding the personal watercraft other than the driver.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 1:
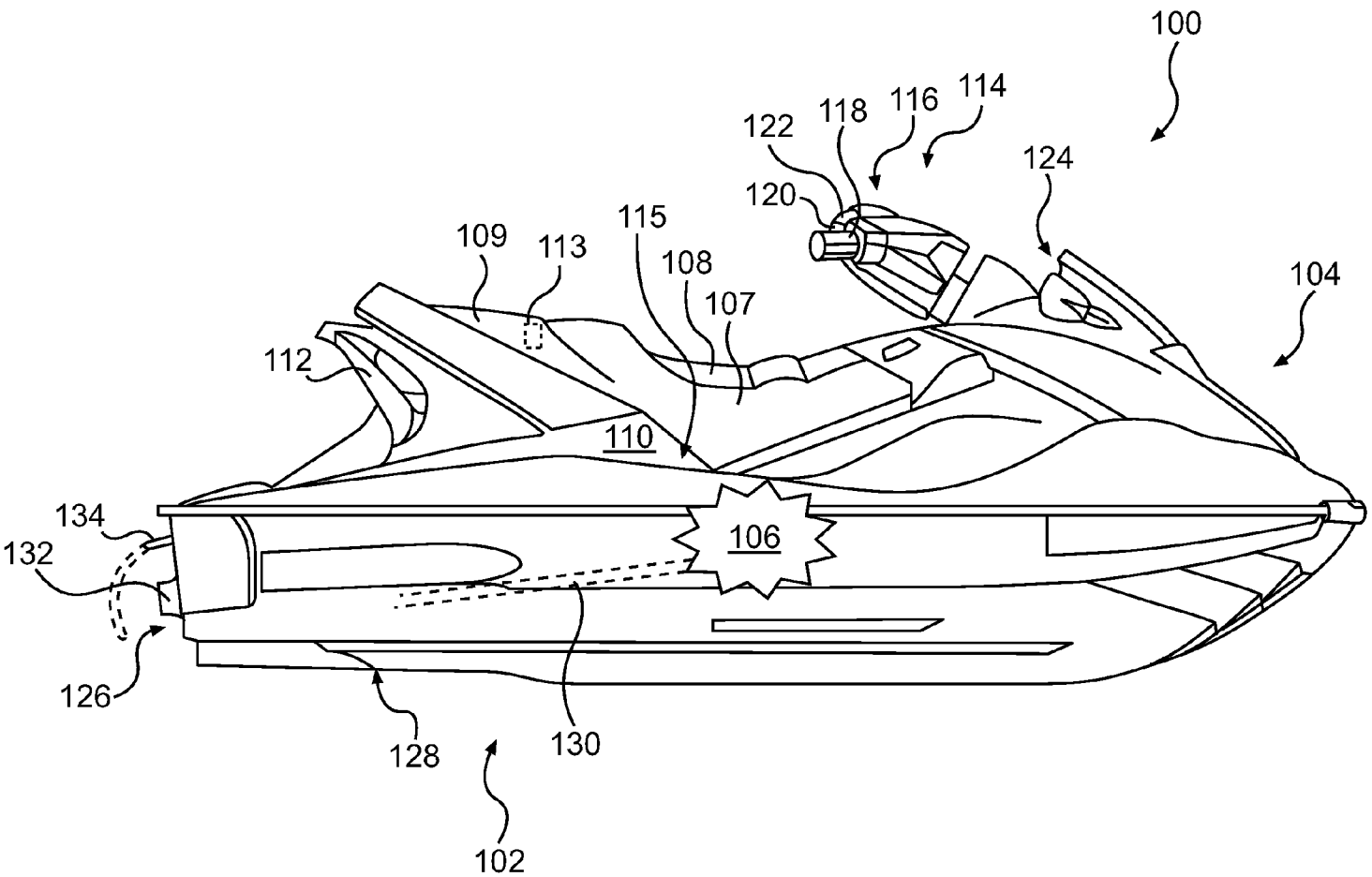
FIG. 1 is a right side elevation view of a personal watercraft.

Referring to FIG. 1, a personal watercraft 100 has a watercraft body made of a hull 102 and a deck 104. The hull 102 buoyantly supports the personal watercraft 100 in the water, and the deck 104 is designed to accommodate a driver and one or more passengers. The volume created between the hull 102 and the deck 104 is known as the engine compartment (not shown). The engine compartment accommodates the engine 106 (schematically illustrated in FIG. 1) as well as the exhaust system, gas tank, electrical system (battery, ECU . . . ), air box, storage bins (not shown) and other elements required or desired for the personal watercraft 100. The function of the ECU will be described in further detail below.

The deck 104 has mounted thereon a straddle-type seat 107 placed on top of a pedestal 110 with a seating position 108 to accommodate a driver and one or more seating positions 109 to accommodate passengers in a straddling position. A grab handle 112 is provided between the pedestal 110 and the seat 107 at the rear of the seat 107 to be gripped by a passenger. It is contemplated that additional or alternative grab points for the passenger may be provided in other locations, such as a seat strap on the seat 107 forwardly of the seating portion 109. A sensor 113 (shown schematically) is disposed beneath the seat 107 for detecting the presence or the absence of one or more passengers on the personal watercraft 100. The sensor 113 may be any known type of sensor. The sensor 113 may be configured to detect any property of the personal watercraft 100 that is indicative of the presence or absence of a passenger, for example: the degree of compression of the seating positions 109 of the seat 107 or a portion thereof; a movement of the seat 108 relative to the watercraft body, particularly if the seat 107 is suspended on the watercraft body by a suspension system; the amount of weight exerted on the seat 107; or the force applied on the watercraft body by the rear portion of the seat 107. Some examples of sensors are described in U.S. patent application Ser. No. 11/864,265, the content of which is incorporated by reference herein. It is contemplated that a separate sensor 113 may be provided corresponding to each passenger seating position 109. It is further contemplated that the sensor 113 may alternatively be provided in a different location on the personal watercraft 100, such as in the footrests 115 or the suspension system of the watercraft 100 if the personal watercraft 100 is provided with a suspension system, for example to determine the amount of weight exerted thereon. It is further contemplated that the sensor 113 may be an optical or ultrasonic sensor for detecting a passenger on the seat portions 109.

A handlebar assembly 114 is positioned generally forward of the seat 107. The handlebar assembly 114 has a central handlebar portion 116, that may be padded, and a pair of handles 118. One of the handles 118 is provided with a throttle operator in the form of a thumb-actuated throttle lever 120. Other types of throttle operators, such as a finger-actuated throttle lever and a twist grip, are also contemplated. The other handle 118 is provided with a switch 122. It is contemplated that the switch 122 may instead be located in any other convenient location within reach of the driver, such as on the same handle 118 as the throttle lever 120, on or next to the display cluster 124, or on the body forward of the seat 107. The function of the switch 122 will be discussed in further detail below.

A display cluster 124 is located forwardly of the handlebar assembly 114 for displaying information to the driver as will be discussed in further detail below.

The personal watercraft 100 is propelled by a jet propulsion system 126 including a jet pump (not shown). It is contemplated that other types of propulsion system, such as propellers, could be used. The jet propulsion system 126 pressurizes water and accelerates it to create thrust. The water is first scooped from under the hull 102 through an inlet grate 128. The inlet grate 128 prevents large rocks, weeds, and other debris from entering the jet propulsion system 126 since they may damage it or negatively affect its performance. Water then flows through the water intake ramp (not shown). From the intake ramp, water then enters the jet pump. The jet pump is made of two main parts: the impeller (not shown) and the stator (not shown). The impeller is coupled to the engine 106 by one or more shafts 130, such as a driveshaft and an impeller shaft. The rotation of the impeller pressurizes the water, which then moves over the stator that is made of a plurality of fixed stator blades (not shown). The role of the stator blades is to decrease the rotational motion of the water so that almost all the energy given to the water is used for thrust, as opposed to swirling the water. Once the water leaves the jet pump, it goes through the venturi (not shown). Since the venturi's exit diameter is smaller than its entrance diameter, the water is accelerated further, thereby providing more thrust. A steering nozzle 132 is pivotally attached to the venturi through a vertical pivot point. The steering nozzle 132 is operatively connected to the handlebar assembly 114 via a push-pull cable (not shown) such that when the handlebar assembly 114 is turned, the steering nozzle 132 pivots, redirects the water coming from the venturi, so as to steer the personal watercraft 100 in the desired direction.

The jet propulsion system 126 is provided with a reverse gate 134 which is movable between a stowed position where it does not interfere with a jet of water being expelled from the steering nozzle 132 and a plurality of positions where it redirects the jet of water being expelled from the steering nozzle 132. During braking, the reverse gate 134 is lowered to a position where it redirects the jet of water in a forward direction, so that the thrust produced by the jet propulsion system 126 slows down the personal watercraft 100. It is contemplated that the reverse gate 126 may also permit the personal watercraft 100 to move in a reverse direction, by redirecting the jet of water in the forward direction when the personal watercraft 100 has fully depleted its forward motion momentum under the preceding braking action or otherwise. It is further contemplated that the reverse gate 126 may be movable to a neutral position wherein the jet of water is only partially redirected in the forward direction such that no net thrust is provided in either the forward or reverse direction and the watercraft 100 remains stationary. The specific construction of the reverse gate 126 will not be described in detail herein. However it will be understood by those skilled in the art that many different types of reverse gate could be provided without departing from the present invention.

Figure 2:
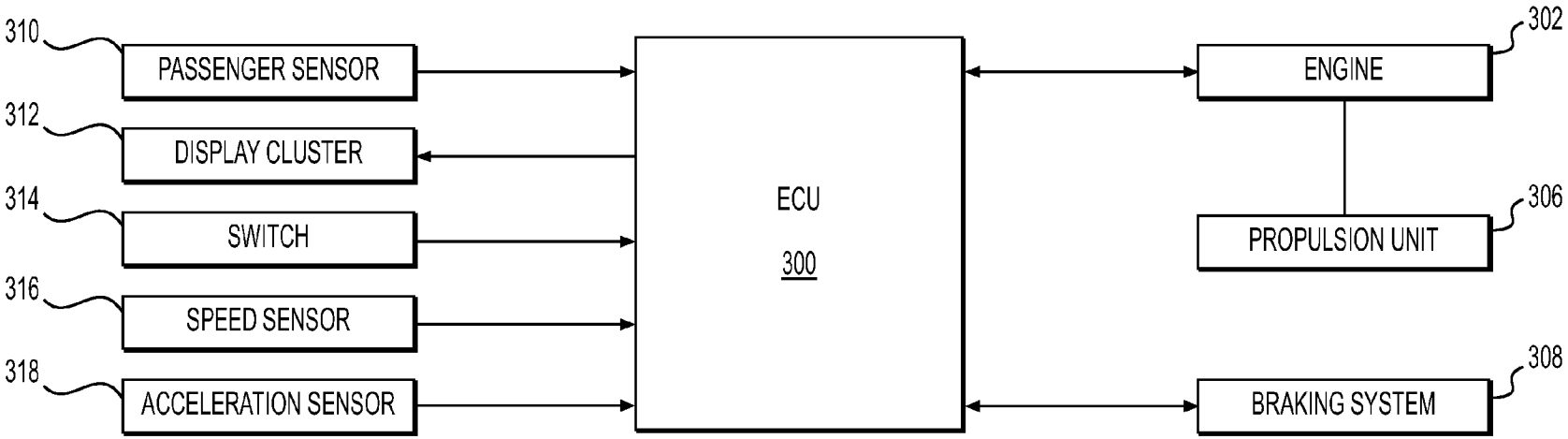
FIG. 2 is a schematic representation of an engine control unit (ECU) and of the components connected thereto, in accordance with at least one embodiment of the present invention.

Turning to FIG. 2, the ECU 300 of the personal watercraft 100 and the components connected thereto in accordance with an embodiment of the present invention will now be described.

In the following description of the ECU 300 and the components connected thereto, some components of the personal watercraft 100, for example the engine, have been renumbered for ease of understanding.

As seen in FIG. 2, the ECU 300 is in communication with various components of the personal watercraft 100, from which it receives signals and to which it sends signals to control their operation. In the present embodiment, the ECU 300 is electrically connected to the engine 302 to receive information from various sensors (not shown) mounted on the engine 302. The ECU 300 controls the operation of the engine 302 based on the information received. The ECU 300 may also be electrically connected to a braking system 308, for example the brake lever or the reverse gate of a watercraft having a reverse gate, to determine the position of the reverse gate. The ECU 300 is also electrically connected to the passenger sensor 310 (corresponding to the sensor 113) for receiving signals indicating the presence or absence of one or more passengers on the personal watercraft. The ECU 300 is also electrically connected to the display cluster 312 for sending signals to the display cluster 312 to display information to the driver. The ECU 300 is also electrically connected to the switch 314 (corresponding to the switch 122) for receiving a signal therefrom when the switch 314 is actuated by the driver. The ECU 300 is also electrically connected to a speed sensor 316 for receiving a signal therefrom indicative of the speed of travel of the personal watercraft 100, and an acceleration sensor 318 for receiving a signal therefrom indicative of an acceleration of the personal watercraft 100. It is contemplated that the ECU 300 may only be electrically connected to some of these components and not to others. For example, if the personal watercraft 100 does not have a reverse gate, the ECU 300 may not be electrically connected to the braking system 308.

Figure 3:
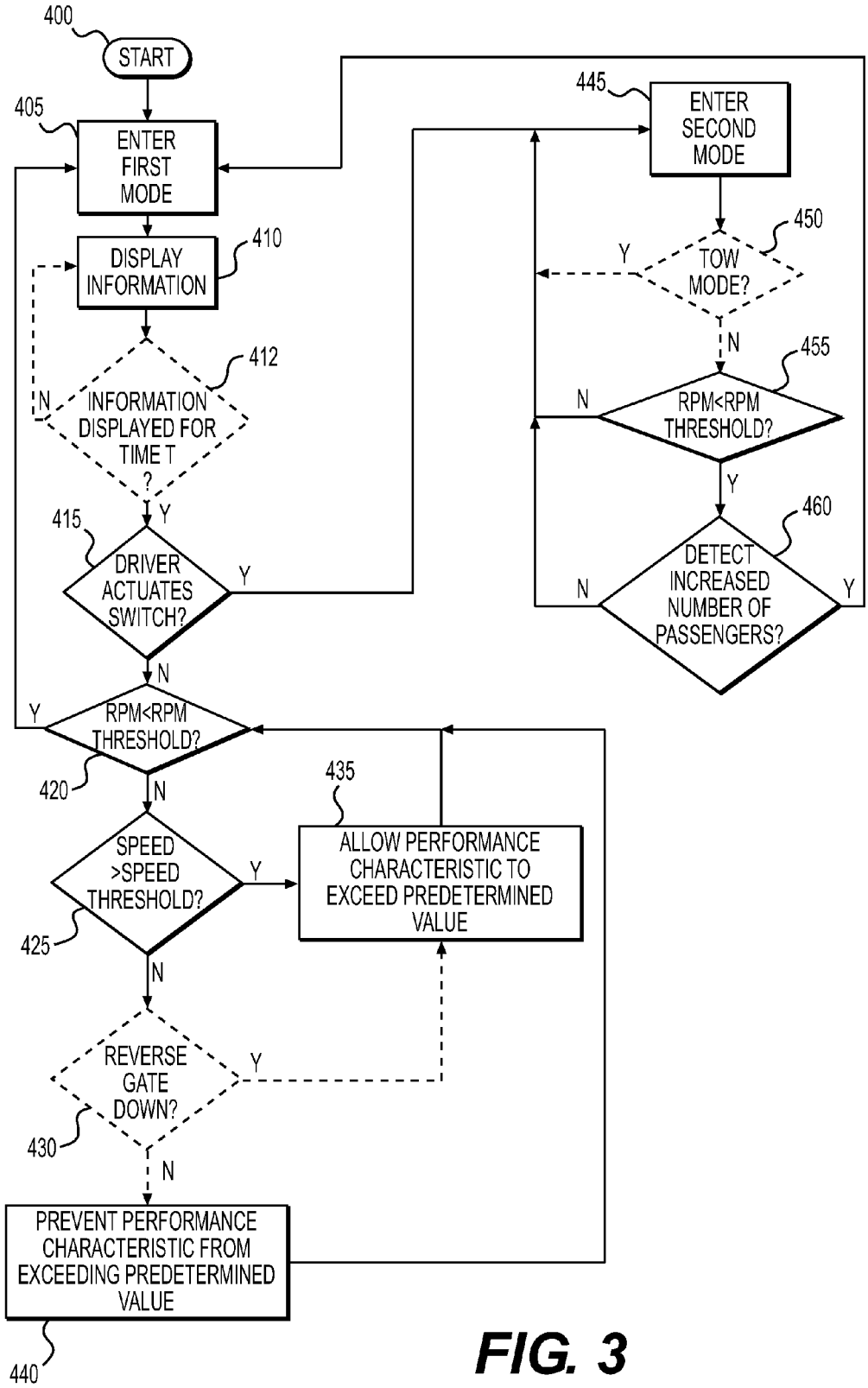
FIG. 3 is a logic diagram of the operation of a personal watercraft in accordance with a first embodiment of the present invention.

Turning to FIG. 3, a method of operating the personal watercraft 100 will now be described according to a first embodiment, starting at step 400 when the driver initiates engine start-up.

At step 405, the ECU 300 enters by default setting the first control mode at engine start-up. In the first engine control mode, the ECU 300 prevents a performance characteristic of the personal watercraft 100 from exceeding a predetermined value less than the maximum value of which the personal watercraft 100 is otherwise capable. In one embodiment, the ECU 300 limits the forward acceleration of the personal watercraft 100 to a predetermined acceleration value. The acceleration may be limited in any suitable way, such as by limiting the speed of the engine 302, manipulating the ignition timing or fuel-air mixture of the engine 302, or limiting the degree of opening of one or more throttle valves of the engine 302 or their rate of opening. The ECU 300 may receive feedback from the speed sensor 316 or the acceleration sensor 318 to ensure that the acceleration remains below the predetermined value. In a second, alternative embodiment, the torque output from the engine 302 is limited to a predetermined torque value less than the maximum torque output of which the engine 302 is capable. The torque may be limited in any suitable way, such as the ways described above for limiting the acceleration. In a third, alternative embodiment, the rate of change of the acceleration of the personal watercraft 100 is limited to a predetermined value. The rate of change of the acceleration may be limited in any suitable way, such as the ways described above for limiting the acceleration. In a fourth, alternative embodiment, a rate of change of the torque output of the engine is limited to a predetermined value. The rate of change of the torque output of the engine may be limited in any suitable way, such as the ways described above for limiting the acceleration. The rate of change of the torque output may also be controlled by maps or dynamically via programming of the ECU 300. For example, if the operator/driver requests the engine 302 to reach a certain speed value that would force one of the other parameters (e.g. the rate of acceleration) to exceed a predetermined value (e.g. a predetermined rate of acceleration) the ECU 300 can be programmed to have the rate of change of the torque output of the engine be such that at all times the rate of acceleration is below a local predetermined rate of acceleration. Such programming can be used to break down the ramping up of the watercraft speed to the requested speed into intermediate steps. At each intermediate step, the rate of acceleration is programmed to increase up to a local predetermined value of the rate of acceleration. The break down into steps can be further programmed to have time lags in between the steps, or alternatively to have the steps be reached gradually.

The predetermined value of the performance characteristic is preferably a value at which the passenger or passengers of the personal watercraft 100 can timely secure a firm grab on to the driver or other passengers of the personal watercraft 100, or to grab handles provided on the personal watercraft 100, and maintain a balanced posture without experiencing high levels of fatigue or feeling unsteady. The predetermined value can be determined from one or more of a torque output of the engine, a rate of change of the torque output of the engine, an acceleration of the watercraft, and a rate of change of the acceleration of the watercraft. It is contemplated that other parameters could be used to determine the predetermined value. The predetermined value may vary as a function of one or more parameters. For example, the predetermined value may be a function of the speed of the personal watercraft 100 as measured by the speed sensor 316, with higher performance being permitted at higher speeds. Alternatively, the predetermined value may be a function of a speed of the engine 302, measured in RPM, with greater acceleration or torque being permitted at higher engine speeds. From step 405, the process continues at step 410.

At step 410, the ECU 300 causes information to be displayed on the display cluster 312. The information may take any suitable form, such as a blinking light or a backlit icon indicating that the ECU 300 is in the first control mode. The information may alternatively be one or more words indicating that the ECU 300 is in the first control mode, suggesting that the driver consider the well being of his passenger while operating the personal watercraft 100, or providing any other suitable information to the driver. This step may optionally be omitted, in which case the process proceeds directly from step 405 to step 415.

At step 415, if the ECU 300 receives a signal indicating that the driver has actuated the switch 314, the ECU 300 proceeds to step 445 and to enter a second control mode. By entering the second control mode, the driver allows the personal watercraft 100 to exceed a predetermined value. As a consequence, the driver has direct control on the performance he wishes to obtain from the personal watercraft 100. Actuating the switch 314 should be understood to include actuating more than one switch simultaneously or in a particular sequence. In addition, a signal indicating that the driver has actuated the switch 314 should be understood to include the ECU 300 receiving no signal, in the event that the presence of a signal is an indication that the switch 314 has not been actuated. It is contemplated that if information is displayed to the driver at step 410, the ECU 300 may proceed to step 445 in response to receiving the signal only after a predetermined amount of time T has passed (see step 412, FIG. 3), to ensure the driver has sufficient time to view the information prior to actuating the switch 314. The duration of the predetermined amount of time may vary depending on the quantity of information displayed. For example, if the information is a quantity of text that either scrolls across the display cluster 312 or requires several screens to fully display, the predetermined period of time should be long enough to display all of the text on the display cluster 312. If the ECU 300 does not receive a signal indicating that the driver has actuated the switch 314, the ECU 300 proceeds to step 420 and the driver may proceed to operate the personal watercraft 100 in the first control mode.

At step 420, the ECU 300 checks if the personal watercraft 100 is operating below a rpm threshold. Step 420 determines whether the personal watercraft 100 is in an idle state, corresponding to the engine 302 running at idle speed. The idle state generally corresponds to the personal watercraft 100 being stationary or moving at a very low speed, such as below 5 miles per hour. It should be understood that the personal watercraft 100 may not be stationary at idle speed, because unlike most land vehicles a typical personal watercraft 100 has no transmission, such that there is always power transmitted to the propulsion device when the engine is running. If the personal watercraft 100 is in an idle state, the ECU 300 returns to step 405, wherein the ECU 300 remains in the first control mode, and the driver is given another opportunity to actuate the switch 314 at step 415. If the personal watercraft 100 is not in an idle state, the ECU 300 proceeds to step 425.

It is contemplated that step 420 could determine whether the personal watercraft 100 is at a state different from an idle state. For example, step 420 could determine if the personal watercraft 100 is below 4,500 rpm. It is further contemplated that step 420 could also include checking the time for which the engine 302 runs at the idle speed (or low rpm). For example, step 420 could check if the personal watercraft 100 is operating below 4,500 rpm for more than 1 second. It is contemplated that step 420 may be omitted, in which case the ECU 300 would proceed directly from step 415 to step 425.

At step 425, the ECU 300 determines the speed of the personal watercraft 100 based on a signal received from the speed sensor 316. If the watercraft speed is greater than a predetermined threshold speed, the ECU 300 proceeds to step 435. If the watercraft speed is less than the predetermined threshold speed, the ECU 300 proceeds to step 430. It is contemplated that step 425 may be omitted, in which case the ECU 300 would proceed directly from step 420 to step 430. It is further contemplated that the ECU 300 could determine at step 425 a speed of the engine 302 instead of the speed of the personal watercraft 100. In such case, a threshold for the speed of the engine 302 could be 4,250 rpm. The speed of the engine 302 could be based on a signal received from an engine angular speed sensor. It is further contemplated that step 425 could also comprise checking the time for which the speed of the engine 302 is below the speed threshold. For example, step 425 could be determining if the speed of the engine 302 is below 4,250 rpm for more than 1 second.

At step 430, if the personal watercraft 100 has a reverse gate 126, the ECU 300 determines the position of the reverse gate 126. In cases where the personal watercraft 100 does not have a reverse gate 126, step 430 may be omitted and the ECU 300 would proceed directly to step 440. The ECU 300 may make this determination based on a signal received from a position sensor connected to the reverse gate 126, or based on a signal received from a sensor connected to the braking system of the personal watercraft 100. If the reverse gate is in a position wherein it redirects the jet of water being expelled from the steering nozzle 132 (down position), the power output of the engine 302 is being used for braking rather than for acceleration, and it may be desirable to use the maximum power output of the engine 302 for maximum braking effectiveness, even when the ECU 300 is in the first control mode and would otherwise limit the power output of the engine 302. If the reverse gate 126 is in a position wherein it redirects the jet of water being expelled from the steering nozzle 132 to brake the personal watercraft 100, the ECU 300 proceeds to step 435. If the reverse gate 126 is in the stowed position, the ECU 300 proceeds to step 440. It is contemplated that when the reverse gate 126 is in the down position, a second set of predetermined values of performance characteristics, different from the set of predetermined values of performance characteristics when the reverse gate 126 is stowed (first set), could be used. For example, in the second set of predetermined values of performance characteristics, the predetermined engine torque could be higher than the predetermined engine torque of the first set.

At step 435, in response to either a watercraft speed being greater than the predetermined threshold speed at step 425 or a lowered position of the reverse gate 126 at step 430, the ECU 300 allows the performance characteristic to exceed the predetermined value. The process returns to step 420.

At step 440, the ECU 300 prevents, or continues to prevent, the performance characteristic from exceeding the predetermined value. The process returns to step 420. It is contemplated that the process may alternatively continue from step 440 to step 415 and give the driver an opportunity to actuate the switch 314 to enter the second control mode. It is presumed that the driver has already viewed the information displayed on the display cluster 312 when the personal watercraft 100 was started, and does not need to view it a second time.

The cumulative effect of steps 425, 430, 435 and 440, corresponding to operation of the personal watercraft 100 while in the first control mode, is that the ECU 300 prevents the performance characteristic from exceeding the predetermined value while in the first control mode unless the watercraft speed is greater than the threshold speed or the reverse gate 126 (where present) is in a lowered position. Allowing the performance characteristic to exceed the predetermined value at step 435 is a temporary state, and subsists only as long as the speed remains above the threshold or the reverse gate 126 remains lowered. Once these conditions stop being true, the ECU 300 proceeds to step 440 and the performance characteristic is again prevented from exceeding the predetermined value.

At step 445, the ECU 300 enters the second control mode in response to the driver actuating the switch 314 at step 415. In the second control mode, the ECU 300 allows the performance characteristic to exceed the predetermined value. The driver then proceeds to operate the personal watercraft 100. The process continues at step 450. It is contemplated that step 450 may be omitted, as it applies only to a personal watercraft 100 having a driver-selectable tow mode, in which case the process would continue directly to step 455.

At step 450, if the personal watercraft is configured to tow a passenger on water skis or an inflatable device, the ECU 300 may have a driver-selectable tow mode, in which the personal watercraft 100 accelerates according to an acceleration profile selected from a plurality of predetermined acceleration profiles. These acceleration profiles allow the watercraft 100 to accelerate at a specified rate and then maintain a constant speed appropriate for the desired towing application. These acceleration profiles may be pre-programmed in the ECU 300, for example to appeal generally to water skiers having different levels of experience. The acceleration profiles may also be configurable by the driver, for example to duplicate an acceleration profile that appeals to a particular water skier. In the present embodiment, the tow mode is only selectable while the ECU 300 is in the second control mode. The tow mode may be selectable by the driver actuating the switch 314 a second time, or by actuating a different switch provided on the personal watercraft 100. If the ECU 300 is in the tow mode, the ECU 300 returns to step 445, thereby remaining in the second control mode. In this manner, the ECU 300 ensures that the acceleration of the personal watercraft 100 is not limited when it is desired that the watercraft follow a particular predetermined acceleration curve. If the ECU 300 is not in the tow mode, the ECU 300 proceeds to step 455. It should be understood that the tow mode could be any other pre-programmed mode (e.g. cruise control mode or slow speed mode) where a characteristic of the personal watercraft 100 (engine speed, rpm, . . . ) is controlled by a pre-programmed map or program implemented in the ECU 300. It is contemplated that the driver may enter into the tow mode without entering into the second mode. In such a case, selection of entering a tow mode could be offered after step 420. If the tow mode is selected, performance characteristics are allowed to exceed predetermined values (i.e. step 435). If not, step 425 is executed by the ECU 300 after step 420 as described above.

At step 455, the ECU 300 checks whether the personal watercraft 100 is in an idle state, corresponding to the engine 302 running at idle speed or operating at low rpm below a rpm threshold. If the personal watercraft 100 is not in an idle state, the ECU 300 returns to step 445 and remains in the second control mode. If the personal watercraft 100 is in an idle state, the ECU 300 proceeds to step 460. It is contemplated that step 455 could be omitted.

At step 460, the ECU 300 checks whether the number of passengers on the personal watercraft 100 has increased since the personal watercraft 100 was started, or since the last time the personal watercraft 100 was idle. The ECU 300 does this by receiving a signal from the passenger sensor 310 indicating whether one or more passengers is present on the personal watercraft 100, and comparing the number of passengers to a previously detected number of passengers. The ECU 300 may continuously check the number of passengers during operation of the personal watercraft 100 and only perform the comparison when the personal watercraft 100 is idle based on either the maximum or the most recent number of passengers detected since the personal watercraft 100 was last idle. However, depending on the type of passenger sensor 310 being used, it is possible that the movement of the personal watercraft 100 may produce a false reading of the number of passengers. As such, it is preferred that the ECU 300 only use a signal sent by the passenger sensor 310 while the personal watercraft 100 is idle, to ensure a more reliable detection of the number of passengers. In addition, it is presumed that a passenger will only board the personal watercraft 100 while it is idle. It is contemplated that a signal from the passenger sensor 310 indicating that a passenger has alit and another passenger has boarded may be interpreted as an increase in the number of passengers. If no increase in the number of passengers is detected by the ECU 300, the process returns to step 445 and the driver may continue to operate the personal watercraft 100 in the second control mode. If an increase in the number of passengers is detected, the process returns to step 405, the ECU 300 re-enters the first control mode, and the driver is eventually given a further opportunity to re-enter the second control mode by actuating the switch at step 415. This step is performed while the personal watercraft 100 is idle, so that if the ECU 300 enters the first control mode as a result of this step, the resulting limitation of watercraft performance will not occur while the personal watercraft 100 is moving. It is contemplated that this step may be omitted, in which case the ECU 300 would proceed from step 455 to step 405 and enter the first control mode whenever the personal watercraft 100 is idle. It is further contemplated that the ECU 300 may alternatively proceed from step 455 to step 405 and enter the first control mode only after the personal watercraft 100 has been idle for a predetermined period of time. It is further contemplated that step 460 and step 455 may both be omitted, in which case the ECU 300 would remain in the second control mode until the personal watercraft 100 is stopped.

Figure 4:
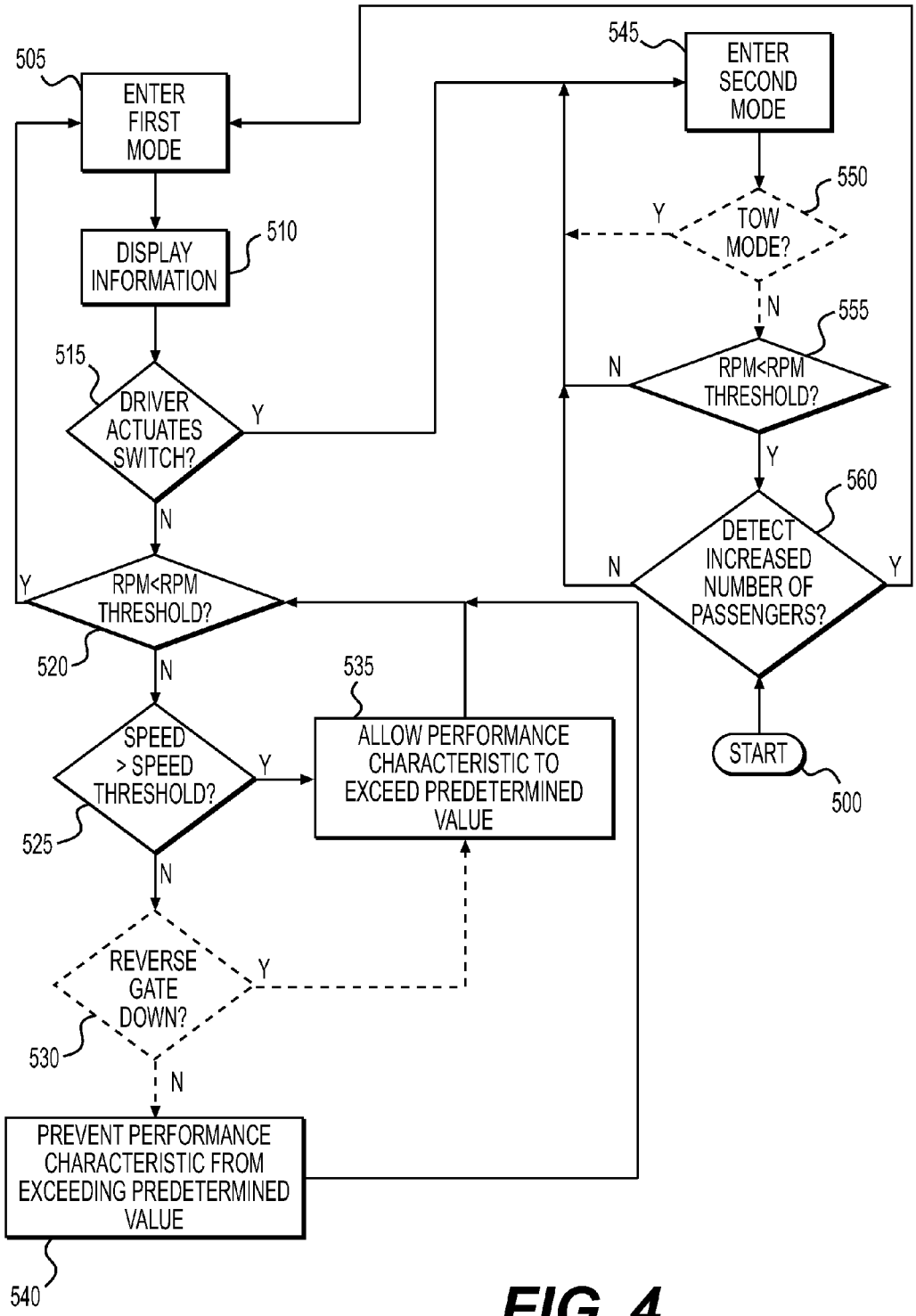
FIG. 4 is a logic diagram of the operation of a personal watercraft in accordance with a second embodiment of the present invention.

Turning to FIG. 4, a method of operating the personal watercraft 100 will now be described according to a second embodiment, starting at step 500 when the driver initiates engine start-up.

The steps 505-555 of FIG. 4 are similar to the respective steps 405-455 of FIG. 3, and will not be described in detail.

The primary difference between the present embodiment and the embodiment of FIG. 3 occurs at engine start-up. The process proceeds from step 500 directly to step 560 at engine start-up. At step 560, the ECU 300 detects the number of passengers on the personal watercraft 100. If one or more passengers are detected at engine start-up, or if an increase in the number of passengers is detected at a later time while the personal watercraft 100 is idle, the process continues at step 505 and the ECU 300 enters the first control mode. If no passenger is detected at engine start-up, the process continues at step 545 and the ECU 300 enters the second control mode. It should be understood that unlike the embodiment of FIG. 3, the present embodiment causes the ECU 300 to enter the first control mode at engine start-up only if at least one passenger is detected on the personal watercraft 100.

It is contemplated that step 515 may be omitted, in which case the ECU 300 would proceed from step 510 directly to step 520. In this case, if the ECU 300 enters the first control mode upon detecting one or more passengers at step 560, it remains in the first control mode throughout the operation of the personal watercraft 100 and the driver is not given the option to enter the second control mode.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A personal watercraft comprising:

a watercraft body having:

a hull; and a deck disposed on the hull;

an engine supported by the hull;

a jet propulsion system supported by the hull and operatively connected to the engine to propel the watercraft;

at least one straddle seat supported on the deck, the at least one seat including a driver seating portion for receiving a driver and at least one passenger seating portion for receiving at least one passenger;

a steering device disposed generally forwardly of the driver seating portion for steering the watercraft;

at least one sensor disposed on the watercraft for detecting at least one of a presence and an absence of a passenger on the at least one passenger seating portion; and a control unit electrically connected to the at least one sensor, the control unit controlling an operation of the watercraft, the control unit entering a first control mode in response to a signal received from the at least one sensor indicative of the presence of a passenger on the at least one passenger seating portion;

the control unit preventing at least one performance characteristic of the watercraft from exceeding a predetermined value in response to the signal received from the at least one sensor being indicative of the presence of a passenger on the at least one passenger seating portion;

the at least one performance characteristic including at least one of a torque output of the engine, a rate of change of the torque output, an acceleration of the watercraft, and a rate of change of the acceleration of the watercraft; and the predetermined value being a corresponding one of a predetermined torque output of the engine, a predetermined rate of change of the torque output, a predetermined acceleration of the watercraft, and a predetermined rate of change of the acceleration of the watercraft.

2. The personal watercraft of claim 1, wherein, when the control unit is in the first control mode, the control unit enters a second control mode in response to at least one of:

a signal received from the at least one sensor, the signal from the at least one sensor being indicative of the absence of a passenger, and actuation of at least one switch disposed on the watercraft body, the at least one switch being electrically connected to the control unit; and wherein the control unit allows the at least one performance characteristic of the watercraft to exceed the predetermined value when in the second control mode.

3. The personal watercraft of claim 2, wherein the sensor detects at least one of a degree of compression of the passenger seating portion, a movement of the at least one passenger seating portion relative to the watercraft body, a weight exerted on the passenger seating portion, and a force applied on the watercraft body by a rear portion of the seat.

4. The personal watercraft of claim 1, wherein the predetermined value is determined by the control unit as a function of at least one of a speed of the watercraft and a speed of the engine.

5. The personal watercraft of claim 2, wherein, when the control unit is in the first control mode, the control unit allows the performance characteristic of the watercraft to exceed the predetermined value when a current speed of the watercraft is greater than a predetermined threshold speed.

6. The personal watercraft of claim 2, further comprising a reverse gate disposed generally rearwardly of the jet propulsion system and being movable between a stowed position and at least one position wherein the reverse gate redirects a flow of water expelled from the jet propulsion system; and wherein when the control unit is in the first control mode, the control unit allows the performance characteristic of the watercraft to exceed the predetermined value when the reverse gate is in the at least one position.

7. The personal watercraft of claim 2, further comprising a display cluster disposed generally forwardly of the driver seating position; and wherein the control unit causes information to be displayed on the display cluster in response to the control unit entering the first control mode.

8. The personal watercraft of claim 7, wherein the control unit enters the second control mode from the first control mode in response to both:

actuation of the at least one switch, and the information having been displayed for a predetermined amount of time.

9. The personal watercraft of claim 2, wherein:

the at least one sensor is capable of detecting one of a presence and an absence of a plurality of passengers on the at least one passenger seating portion; and when the control unit is in the second control mode and the watercraft is in an idle state, the control unit enters the first control mode in response to a signal received from the at least one sensor indicative of the presence of an increased number of passengers on the at least one passenger seating portion.

10. The personal watercraft of claim 1, wherein, when the control unit is in the first control mode, the control unit enters a second control mode in response to a signal received from the at least one sensor, the signal from the at least one sensor being indicative of the absence of a passenger;

wherein the control unit allows the at least one performance characteristic of the watercraft to exceed the predetermined value when in the second control mode; and wherein the control unit enters the first control mode at engine start-up, independently of the signal received from the at least one sensor indicative of the presence of a passenger on the at least one passenger seating portion.

11. A method of controlling a personal watercraft having a driver seating portion for receiving a driver and at least one passenger seating portion for receiving at least one passenger, the method comprising:

causing a control unit to enter a first control mode in response to a signal received from at least one sensor indicative of a presence of a passenger on the at least one passenger seating portion;

causing the control unit to enter a second control mode in response to an other signal when the control unit is in the first control mode;

preventing at least one performance characteristic of the watercraft from exceeding a predetermined value in response to the signal received from the at least one sensor being indicative of a presence of a passenger on the at least one passenger seating portion; and allowing the at least one performance characteristic of the watercraft to exceed the predetermined value while the control unit is in the second control mode;

the at least one performance characteristic including at least one of a torque output of an engine of the watercraft, a rate of change of the torque output, an acceleration of the watercraft, and a rate of change of the acceleration of the watercraft; and the predetermined value is a corresponding one of a predetermined torque output of the engine, a predetermined rate of change of the torque output, a predetermined acceleration of the watercraft, and a predetermined rate of change of the acceleration of the watercraft.

12. The method of controlling a personal watercraft of claim 11, wherein the other signal is at least one of:

a signal received from the at least one sensor indicative of an absence of a passenger on the at least one passenger seating portion; and a signal received from at least one driver-actuated switch of the watercraft.

13. The method of claim 12, further comprising:

allowing the at least one performance characteristic of the watercraft to exceed the predetermined value when a speed of the watercraft is greater than a predetermined threshold speed when the control unit is in the first control mode.

14. The method of claim 12, wherein the watercraft has a reverse gate disposed generally rearwardly of a jet propulsion system, the reverse gate being movable between a stowed position and at least one position wherein the reverse gate redirects a flow of water expelled from the jet propulsion system, the method further comprising:

allowing the at least one performance characteristic of the watercraft to exceed the predetermined value when the reverse gate is in the at least one position and the control unit is in the first control mode.

15. The method of claim 12, wherein the other signal is the signal received from the at least one driver-actuated switch;

wherein the signal received from the at least one driver-actuated switch is a first signal received from the at least one driver-actuated switch; and further comprising:

causing the control unit to enter a towing mode in response to a second signal received from the at least one driver-actuated switch of the watercraft;

allowing the driver to select an acceleration profile of the watercraft from a plurality of predetermined acceleration profiles while in the towing mode; and preventing the control unit from entering the first control mode while the control unit is in the towing mode.

16. The method of claim 12, further comprising:

when the control unit is in the second control mode and the watercraft is in an idle state, causing the control unit to enter the first control mode in response to a signal received from at least one sensor indicative of an increased number of passengers on the at least one passenger seating portion.

17. The method of claim 12, further comprising:

displaying information on a display cluster when the control unit is in the first control mode.

18. The method of claim 17, further comprising:

causing the control unit to enter the second control mode in response to both:

the first signal, and the information having been displayed for a predetermined period of time.

19. The method of claim 11, wherein the predetermined value is determined by the control unit as a function of at least one of a speed of the watercraft and a speed of the engine.

20. A method of controlling a personal watercraft, comprising:

causing a control unit to enter a first control mode at engine start-up;

displaying information on a display cluster when the control unit is in the first control mode;

causing the control unit to enter a second control mode from the first control mode in response to both:

a first signal received from at least one driver-actuated switch of the watercraft, and the information having been displayed for a predetermined period of time;

preventing at least one performance characteristic of the watercraft from exceeding a predetermined value while the control unit is in the first control mode; and allowing the at least one performance characteristic of the watercraft to exceed the predetermined value while the control unit is in the second control mode.

21. The method of claim 20, further comprising:

allowing the at least one performance characteristic of the watercraft to exceed the predetermined value when a speed of the watercraft is greater than a predetermined threshold speed when the control unit is in the first control mode.

22. The method of claim 20, wherein the personal watercraft has a reverse gate disposed generally rearwardly of a jet propulsion system, the reverse gate being movable between a stowed position and at least one position wherein the reverse gate redirects a flow of water expelled from the jet propulsion system, the method further comprising:

allowing the at least one performance characteristic of the watercraft to exceed the predetermined value when the reverse gate is in the at least one position and the control unit is in the first control mode.

23. The method of claim 20, further comprising:

causing the control unit to enter a towing mode in response to a second signal received from the at least one driver-actuated switch of the watercraft;

allowing the driver to select an acceleration profile of the watercraft from a plurality of predetermined acceleration profiles while in the towing mode; and preventing the control unit from entering the first control mode while the control unit is in the towing mode.

24. The method of claim 20, wherein:

the at least one performance characteristic includes at least one of a torque output of the engine, a rate of change of the torque output, an acceleration of the watercraft, and a rate of change of the acceleration of the watercraft; and the predetermined value is a corresponding one of a predetermined torque output of the engine, a predetermined rate of change of the torque output, a predetermined acceleration of the watercraft, and a predetermined rate of change of the acceleration of the watercraft.

25. The method of claim 20, wherein the predetermined value is determined by the control unit as a function of at least one of a speed of the watercraft and a speed of the engine.

* * * * *